US012268975B2

(12) United States Patent
Todokoro

(10) Patent No.: US 12,268,975 B2
(45) Date of Patent: Apr. 8, 2025

(54) TRACK RUNNING TOY

(71) Applicant: AGATSUMA CO., LTD., Toyko (JP)

(72) Inventor: Shinji Todokoro, Tokyo (JP)

(73) Assignee: AGATSUMA CO., LTD., Tokyo (JP)

( * ) Notice: Subject to any disclaimer, the term of this patent is extended or adjusted under 35 U.S.C. 154(b) by 753 days.

(21) Appl. No.: 17/551,987

(22) Filed: Dec. 15, 2021

(65) Prior Publication Data

US 2022/0193568 A1 Jun. 23, 2022

(30) Foreign Application Priority Data

Dec. 17, 2020 (JP) ..... 2020-208880

(51) Int. Cl.
*A63H 19/32* (2006.01)
*A63H 19/04* (2006.01)

(52) U.S. Cl.
CPC ..... *A63H 19/32* (2013.01); *A63H 19/04* (2013.01)

(58) Field of Classification Search
CPC ..... A63H 19/04; A63H 19/32
See application file for complete search history.

(56) References Cited

U.S. PATENT DOCUMENTS

| | | | | |
|---|---|---|---|---|
| 12,064,703 | B2 * | 8/2024 | Murakami | A63H 18/028 |
| 2022/0193568 | A1 * | 6/2022 | Todokoro | A63H 17/00 |

FOREIGN PATENT DOCUMENTS

| | | | | |
|---|---|---|---|---|
| JP | S47 11772 | | 5/1972 | |
| JP | S50 41697 | U | 4/1975 | |
| JP | S53 53454 | A | 5/1978 | |
| JP | 2006181241 | A * | 7/2006 | |
| JP | 2014023709 | A * | 2/2014 | |
| JP | 31-99932 | U1 | 8/2015 | |
| JP | 3199932 | U * | 9/2015 | |
| JP | 2022168302 | A * | 11/2022 | A63H 17/00 |

OTHER PUBLICATIONS

Extended European Search Report received in related Patent Application No. 21214321.8-1122 dated Jun. 8, 2022.

* cited by examiner

*Primary Examiner* — Jason C Smith
(74) *Attorney, Agent, or Firm* — THE MARBURY LAW GROUP, PLLC

(57) ABSTRACT

A track running toy has a rotational device, whose track surface main body has a track surface and an entry and exit portion. An entry and exit guide member has an entry guide portion guiding a running body from the entry and exit portion to the track surface and an exit guide portion guiding the running body from the entry and exit portion to the same portion. An entry and exit control member is provided at the entry and exit portion, has a pop-up guide portion formed to follow a track guide portion and a running surface, and projects while tilting, whereby the running surface connects to the track surface by operating an operating body. A pop-up abutment member is switched from a retracted to a projecting state when operating the operating body and abuts a stopping abutment portion of the entry and exit guide member when projecting.

7 Claims, 11 Drawing Sheets

TRACK RUNNING TOY

CROSS-REFERENCE TO RELATED APPLICATION

This patent application is based upon and claims the benefit of priority under 35 USC 119 from Japanese Patent Application No. 2020-208880 filed on Dec. 17, 2020, the entire disclosure of which, including the specification, claims, drawings and abstract, is incorporated herein by reference.

BACKGROUND

Field of the Invention

The present invention relates to a track running toy.

Description of the Related Art

There have conventionally been disclosed track running toys including a switching device for switching running directions of a running body. For example, Japanese Utility Model Registration No. 3199932 discloses a track running toy including a switching device for switching a bifurcated track. In this switching device, when the running toy comes into abutment with a guide member of the switching device, the bifurcated track is alternately switched between one track and the other track thereof.

The track running toy in which the bifurcated track is switched has the track connecting to one end and the track connecting to the other end of the bifurcated track, as a result of which the toy itself is enlarged in size. This may make it difficult for an infant to handle the toy from time to time.

SUMMARY OF THE INVENTION

The present invention has been made in view of the situations described above, and an object thereof is to provide a track running toy which can be formed compact in size.

According to an aspect of the present invention, there is provided a track running toy including a rotational device, the rotational device including a track surface main body including a track surface formed so as to enable a self-propelled running body to run along a track guide portion and an entry and exit portion where the self-propelled running body enters and exits from the track surface, an entry and exit guide member including an entry guide portion configured to guide the self-propelled running body which enters from the entry and exit portion to the track surface and an exit guide portion configured to guide the self-propelled running body which exits from the entry and exit portion to the entry and exit portion, an entry and exit guide member support portion configured to enable the entry guide portion and the exit guide portion to move along the track surface, an entry and exit control member including a pop-up guide portion provided at the entry and exit portion and formed so as to follow the track guide portion and a running surface on which the self-propelled running body can run and configured to project in a tilting fashion, wherein the running surface connects to the track surface by the pop-up guide portion being retracted as a result of operation of an operating body, and a pop-up abutment member configured to be switched between a retracted state and a projecting state in response to operation of the operating body and to come into abutment with a stopping abutment portion of the entry and exit guide member when in the projecting state to thereby make the exit guide portion function.

With the track running toy according to the present invention, the track running toy can be provided which can be formed compact in size.

DESCRIPTION OF THE PREFERRED EMBODIMENT

Figure 1:
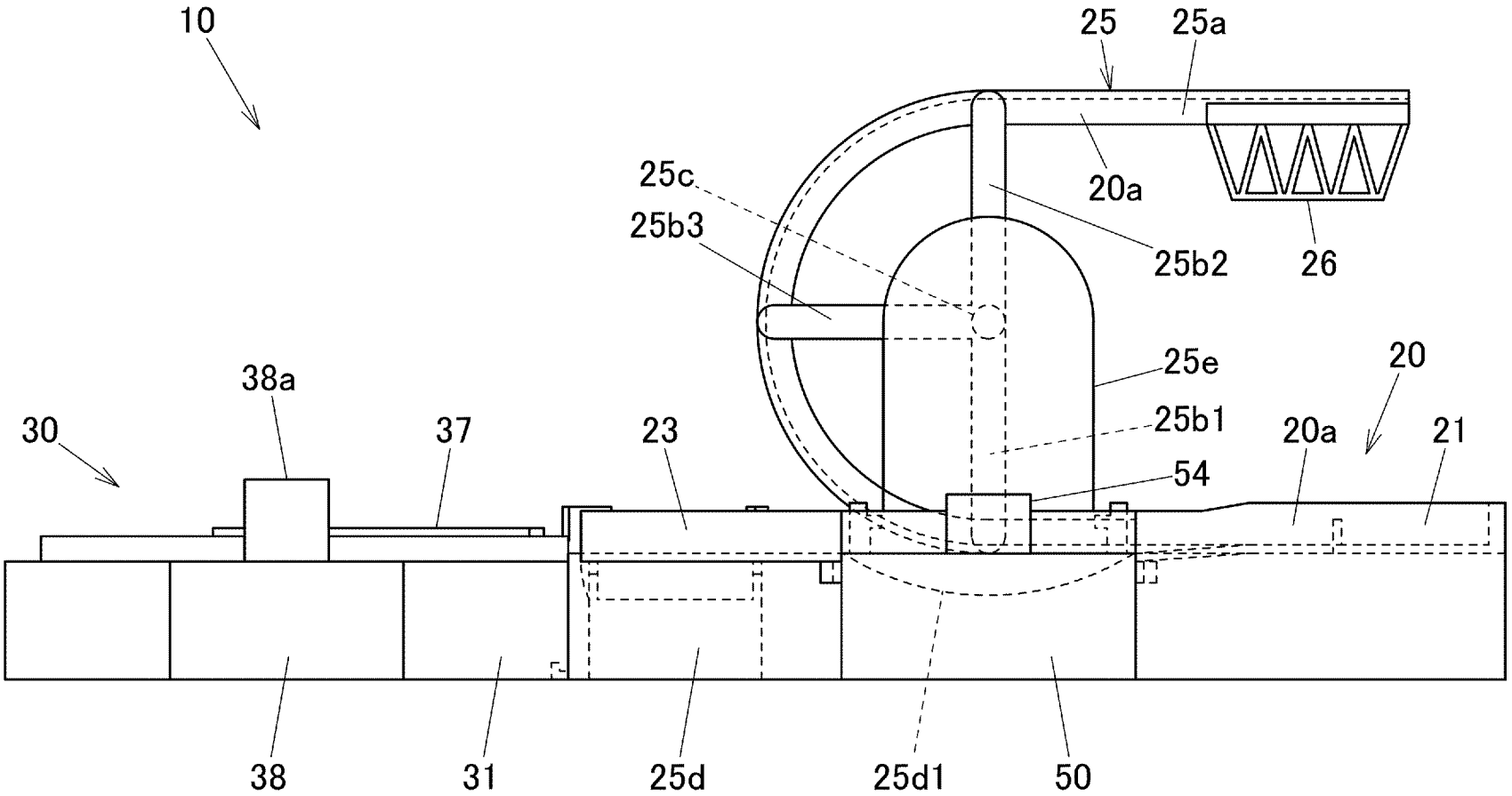
FIG. 1 is a schematic front view of a track running toy according to an embodiment of the present invention.
Figure 2:
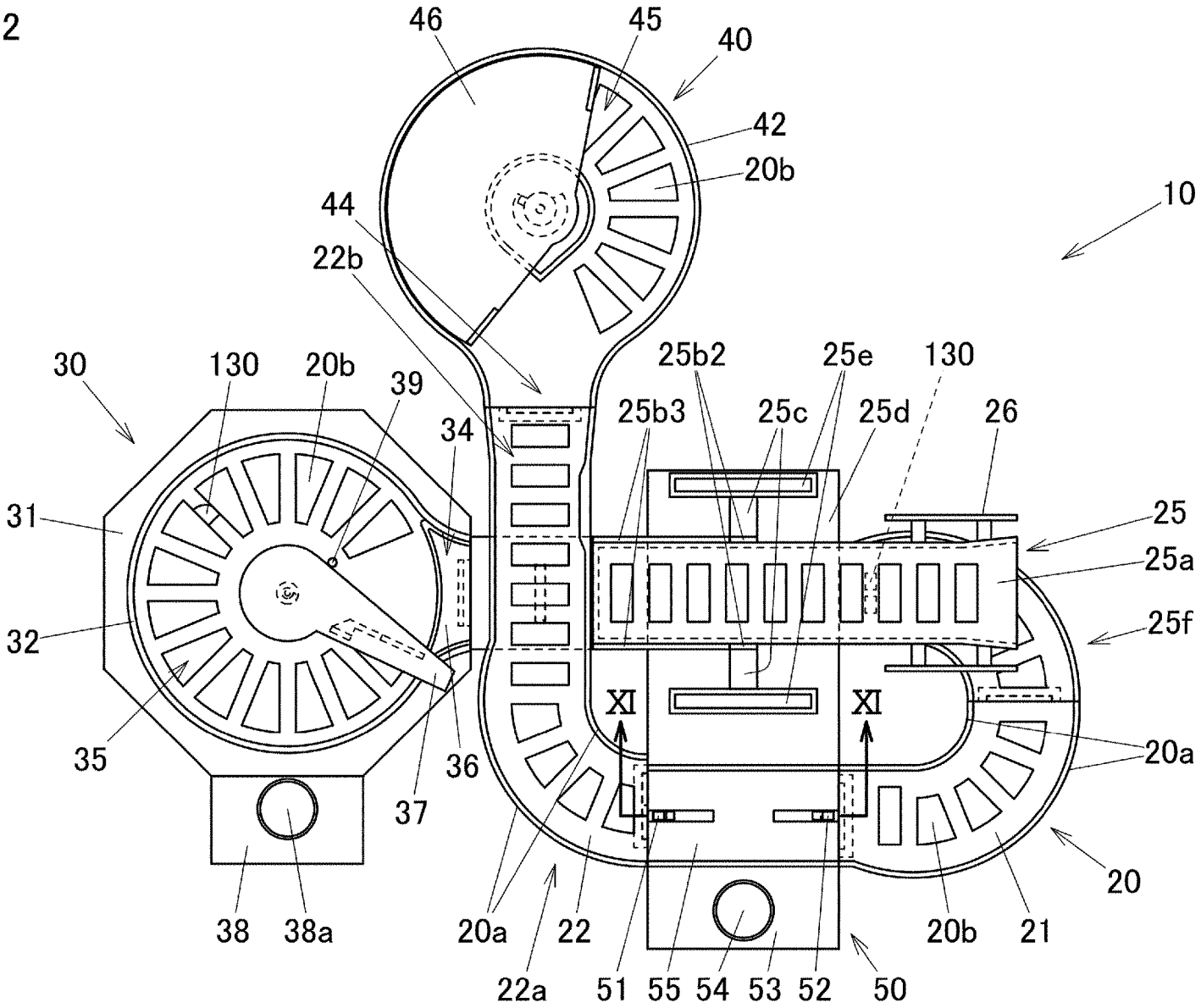
FIG. 2 is a schematic plan view of the track running toy according to the embodiment of the present invention.
Figure 4A:
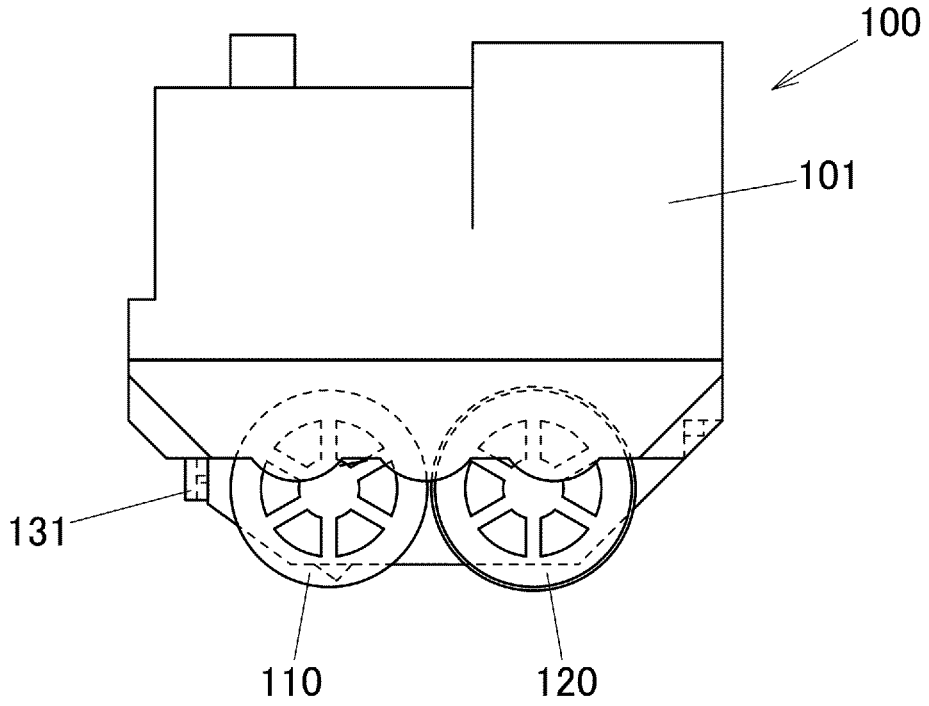
FIG. 4A is a schematic side view of a self-propelled running body of the track running toy according to the embodiment of the present invention.
Figure 4B:
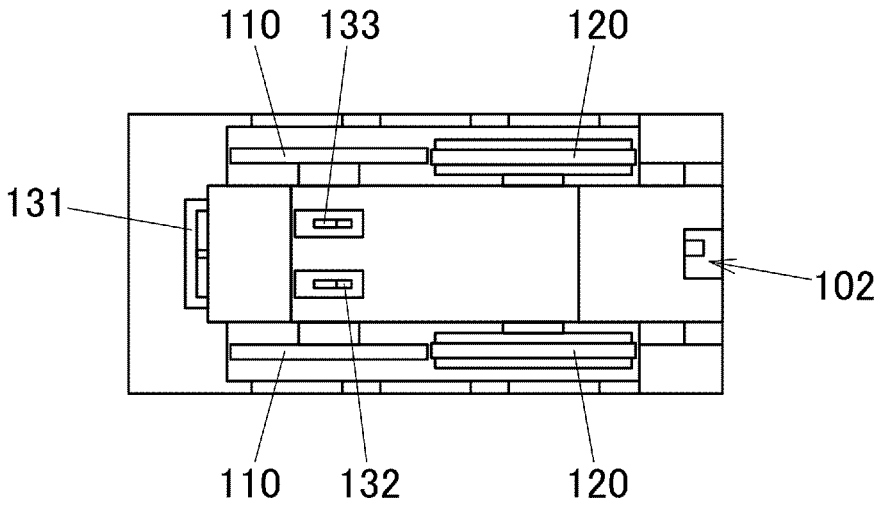
FIG. 4B is a schematic bottom view of the self-propelled running body of the track running toy according to the embodiment of the present invention.

Hereinafter, referring to drawings, an embodiment of the present invention will be described. A track running toy 10, shown in FIGS. 1, 2, is a toy with which a player enjoys playing by watching a self-propelled running body 100, which imitates a locomotive shown in FIGS. 4A, 4B, starting from a start platform 50 and running through a fixed track 20, a rotational track 25, a rotational device 30, and a reversing device 40.

The fixed track 20 (a first fixed track 21, a second fixed track 22) and a track main body 25*a* of the rotational track 25 have wall portions 20*a* which are erected along both edge portions thereof in such a manner as to guide the running of the self-propelled running body 100. A rail shape 20*b*, which is made up of substantially rectangular holes and patterns (that is, portions where no hole is opened), is imparted to track surfaces of the fixed track 20, the rotational track 25, the rotational device 30, and the reversing device 40 so as to imitate rails. The fixed track 20 and the start platform 50, the rotational device 30, and the reversing device 40 are detachably connected together through concavo-convex engagement.

In the rotational track 25, three rotational support rods 25*b*1, 25*b*2, 25*b*3 are fixed individually to corresponding portions of the wall portion 20*a* of the track main body 25*a*, which is formed into a substantially U-like shape. In the rotational support rods 25*b*1, 25*b*2, 25*b*3, the rotational support rods 25*b*1, 25*b*2 are provided to extend in a straight line over a full diametrical distance inside the substantially U-like shape (to describe this in greater detail, between connecting portions where a straight-line portion and a curvilinear portion of the substantially U-like shape connect to each other), and the rotational support rod 25*b*3 is provided to extend from a connecting portion between the rotational support rod 25*b*1 and the rotational support rod 25*b*2, which substantially continue in a straight line, towards the curvilinear portion of the substantially U-like shape in such a manner as to be at right angles to the rotational support rods 25*b*1, 25*b*2. A position where the rotational support rods 25*b*1, 25*b*2, 25*b*3 meet is referred to as a shaft portion 25*c*. The shaft portion 25*c* is supported rotatably by two shaft support plates 25*e* which are erected face to face from a pedestal 25*d*.

A truss bridge portion 26, which imitates an iron bridge, is provided on the wall portions 20*a* at one end of the substantially U-like shape of the track main body 25*a*. A curvilinear portion 25*f*, which curves towards the first fixed track 21, is provided at the other end of the substantially curvilinear shape of the track main body 25*a*. When the rotational track 25 rotates, in a state shown in FIG. 1, the curvilinear portion 25*f* connects to the first fixed track 21, while in a state shown in FIG. 2, a track of the truss bridge portion 26 connects to an entry and exit portion 34 of the rotational device 30. A recessed portion 25*d*1 is provided on the pedestal 25*d* so as to avoid an interference with the track main body 25*a* when the track main body 25*a* rotates. The rotational device 30 is detachably connected with the pedestal 25*d* through concave-convex engagement.

A track surface 55 of the start platform 50 is disposed parallel to a straight-line portion of the rotational track 25 (the track main body 25*a*), and one end of the track surface 55 connects to the first fixed track 21. Since the first fixed track 21 connects with the curvilinear portion 25*f* of the rotational track 25, the first fixed track 21 is formed curvilinearly with the same curvature as that of the curvilinear portion 25*f*. The other end of the track surface 55 of the start platform 50 connects to the second fixed track 22. The second fixed track 22 has a curvilinear portion 22*a*, which connects with the start platform 50, and a straight-line portion 22*b*, which is directed at right angles to the track surface 55 of the start platform 50. An end portion of the straight-line portion 22*b* of the second fixed track 22 connects to the reversing device 40.

Figure 3:
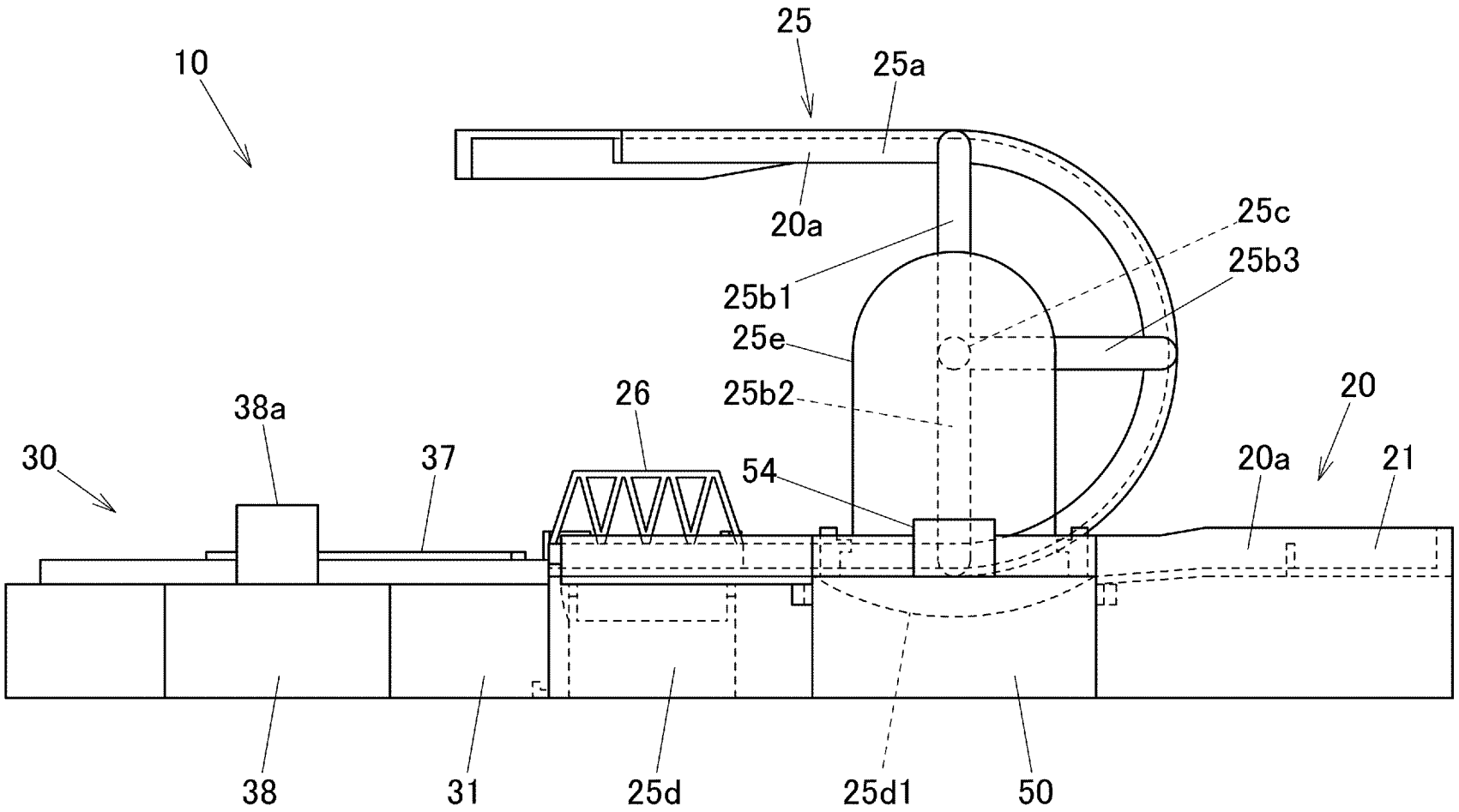
FIG. 3 is a schematic front view of the track running toy according to the embodiment of the present invention with a rotational track of the track running toy rotated from a state shown in FIG. 1.

For example, in the state shown in FIG. 1, when the self-propelled running body 100 enters the rotational track 25 from the first fixed track 21, the rotational track 25 rotates at a point in time when the self-propelled running body 100 is about to enter the curvilinear portion of the substantially U-like shape of the track main body 25*a*, and as shown in FIG. 3, the truss bridge portion 26 is placed over the second fixed track 22 to connect with the rotational device 30. A balance weight, not shown, is provided on the rotational track 25 as required so as to prevent the rotational track 25 from rotating while rocking. The self-propelled running body 100, which exits from the rotational device 30, enters the rotational track 25, which connects to the rotational device 30, from the truss bridge portion 26. Then, the rotational track 25 rotates again to return to the state shown in FIG. 1, where the curvilinear portion 25*f* connects to the first fixed track 21.

The self-propelled running body 100, shown in FIG. 4, is configured as a four-wheel vehicle having two front wheels 110 and two rear wheels 120 which are provided at a lower portion of a locomotive main body 101. Widths between the front wheels 110 and the rear wheels 120 are set to something like a width dimension with which the front wheels 110 and the rear wheels 120 come close to or into contact with facing inner surfaces of the wall portions 20*a* of the fixed track 20 and the rotational track 25. The rear wheels 120 are driven by a motor, not shown, which is provided in an interior thereof. A first switch 131 is provided at a lower portion of a front surface of the locomotive main body 101, and a limit switch, whose pressing direction is a front-rear direction (a front-rear direction of a traveling direction) of the self-propelled running body 100, is provided on the first switch 131. A second switch 132 and a third switch 133 are provided at a front of a lower surface of the locomotive main body 101 in such a manner as to be aligned in an axial direction of the front wheels 110, and a limit switch is provided on each of the second switch 132 and the third switch 133. The first switch 131, the second switch 132, and the third switch 133 are biased in a projecting direction by corresponding biasing members. Additionally, a power supply switch 102 is provided at a rear on the lower surface of the locomotive main body 101.

The first switch 131, the second switch 132, and the third switch 133 are such that voice or sound information is emitted from a speaker (not shown) inside the locomotive main body 101 in accordance with combinations of the switches that are depressed. Although the details will be described later on, in the start platform 50, the first switch 131 is depressed by locking rods 51, 52. Additionally, an identification body 130, which has a projecting shape, is provided on the track surfaces of the fixed track 20, the rotational track 25, and the rotational device 30 as required so as to depress the second switch 132 and the third switch 133.

Next, referring to FIGS. 5 to 9, the rotational device 30 will be described. The rotational device 30 has a track surface main body 31 having a substantially regular octagonal shape in a plan view. A circular track surface 35 is formed on the track main surface main body 31, and a substantially circular track guide portion 32 is provided on an outer circumference of the track surface 35. The track guide portion 32 is formed into a wall-like shape which is erected from the track surface 35. An entry and exit portion 34 is provided on the rotational device 30 where the self-propelled running body 100 enters and exits from the track surface 35. The track guide portion 32 is extended to the entry and exit portion 34. The entry and exit portion 34 includes an entry and exit control member 36. The entry and exit control member 36 is formed into a substantially L-like shape in a side view (refer to FIG. 9). The entry and exit control member 36 has, at one end of the substantially L-like shape, a pop-up guide portion 36*a*, which is formed into a recessed arc-like shape in a plan view, and a flat running surface 36*b*, which is exposed to an upper surface side, in such a manner as to follow the track guide portion 32. Although it will be described in detail later, the entry and exit control member 36 can tilt and projects from the track surface 35. When the entry and exit control device 36 projects from the track surface 35, the pop-up guide portion 36*a* can guide the self-propelled running body 100 together with the track guide portion 32. Then, when the self-propelled running body 100 is entering the track surface 35, the entry and exit control member 36 tilts downwards, thereby allowing the running surface 36*b* to connect to the track surface 35. In addition, the entry and exit control member 36 also tilts downwards by a depressing operation of an operating body 38*a*, which will be described later. Also, when the entry and exit control member 36 tilts downwards by operating the operating body 38*a*, the running surface 36*b* of the entry and exit control member 36 connects to the track surface 35.

Figure 6:
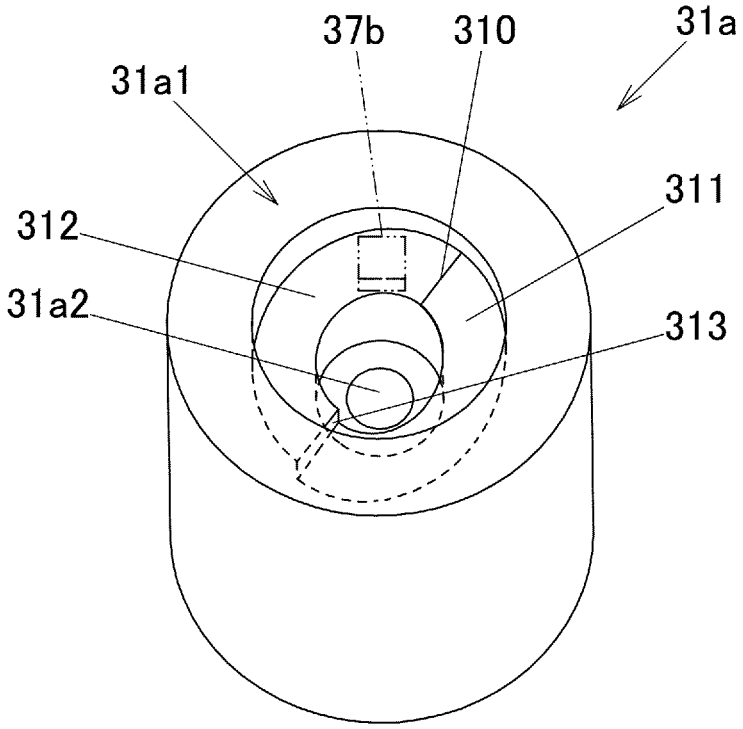
FIG. 6 is a schematic perspective view of a cam portion of the rotational device of the track running toy according to the embodiment of the present invention.

An entry and exit guide member 37 is provided on the track surface 35 of the rotational device 30. The entry and exit guide member 37 includes a pin member 37*a*, which is configured as a rotational shaft erected towards the track surface main body 31, and a cam follower 37*b*, which is formed into a projecting shape, the pin member 37*a* and the cam follower 37*b* being provided on a lower surface of a circular base portion of the entry and exit guide member 37. On the other hand, a cam portion 31*a*, which is formed into a substantially circular cylindrical shape, is provided substantially at a center of the track surface main body 31 (that is, a center of the circular track surface 35). As shown in FIG. 6, in the cam portion 31*a*, a cam surface 31*a*1 is formed on an edge surface of an end portion of the substantially circular cylindrical shape. The cam surface 31*a*1 has a first sloping cam surface 311, which slopes up towards an apex portion 310, and a second sloping cam surface 312, which slopes down from the apex portion 310. The first sloping cam surface 311 and the second sloping cam surface 312 connect to each other at the apex portion 310 at first ends and connect to each other at second ends thereof via an engagement step portion 313. The pin member 37*a* of the entry and exit guide member 37 is rotatably inserted into a center hole 31*a*2 of the cam portion 31*a* of the substantially circular cylindrical shape. The center hole 31*a*2 and the pin member 37*a* make up an entry and exit guide member support portion 315, which is configured so as to enable an entry guide portion 371 and an exit guide portion 372, which will both be described later, to move along the guide surface 35. In addition, the cam follower 37*b* of the entry and exit guide member 37 slides on the cam surface 31*a*1 of the cam portion 31*a* to be brought into engagement with the engagement step portion 313. With no external force applied to the entry and exit guide member 37, the cam follower 37*b* engages with the engagement step portion 313.

The entry and exit guide member 37 is formed into a substantially trapezoidal plate-like shape which extends long. In the entry and exit guide member 37, one longitudinal side is configured as an entry guide portion 371, while the other longitudinal side is configured as an exit guide portion 372. The cam follower 37*b* of the entry and exit guide member 37 is in engagement with the engagement step portion 313 in a position indicated by a solid line in FIG. 5A. That is, in such a state that the cam follower 37*b* is in engagement with the engagement step portion 313, the entry and exit guide member 37 never starts moving even though a certain magnitude of force is applied to the entry and exit guide member 37 in a counterclockwise direction as viewed in FIG. 5A. In the position indicated by the solid line in FIG. 5A, the entry guide portion 371 guides the self-propelled running body 100, which is now entering from the entry and exit portion 34, to the track surface 35.

A pop-up abutment member 39, having a pin shape, which is configured to pop up from and be retracted into the track surface 35, is provided closer to the center of the track surface 35. When the operating body 38*a* is depressed, the pop-up abutment member 39 projects from the track surface 35. On the other hand, a plate-shaped stopping abutment portion 37*c* is provided on a lower surface of the entry and exit guide member 37 in such a manner as to be erected downwards therefrom. In a position indicated by a chain double-dashed line in FIG. 5A, the exit guide portion 372 of the entry and exit guide member 37 guides the self-propelled running body 100, which is exiting from the entry and exit portion 34, towards the entry and exit portion 34.

Figure 5A:
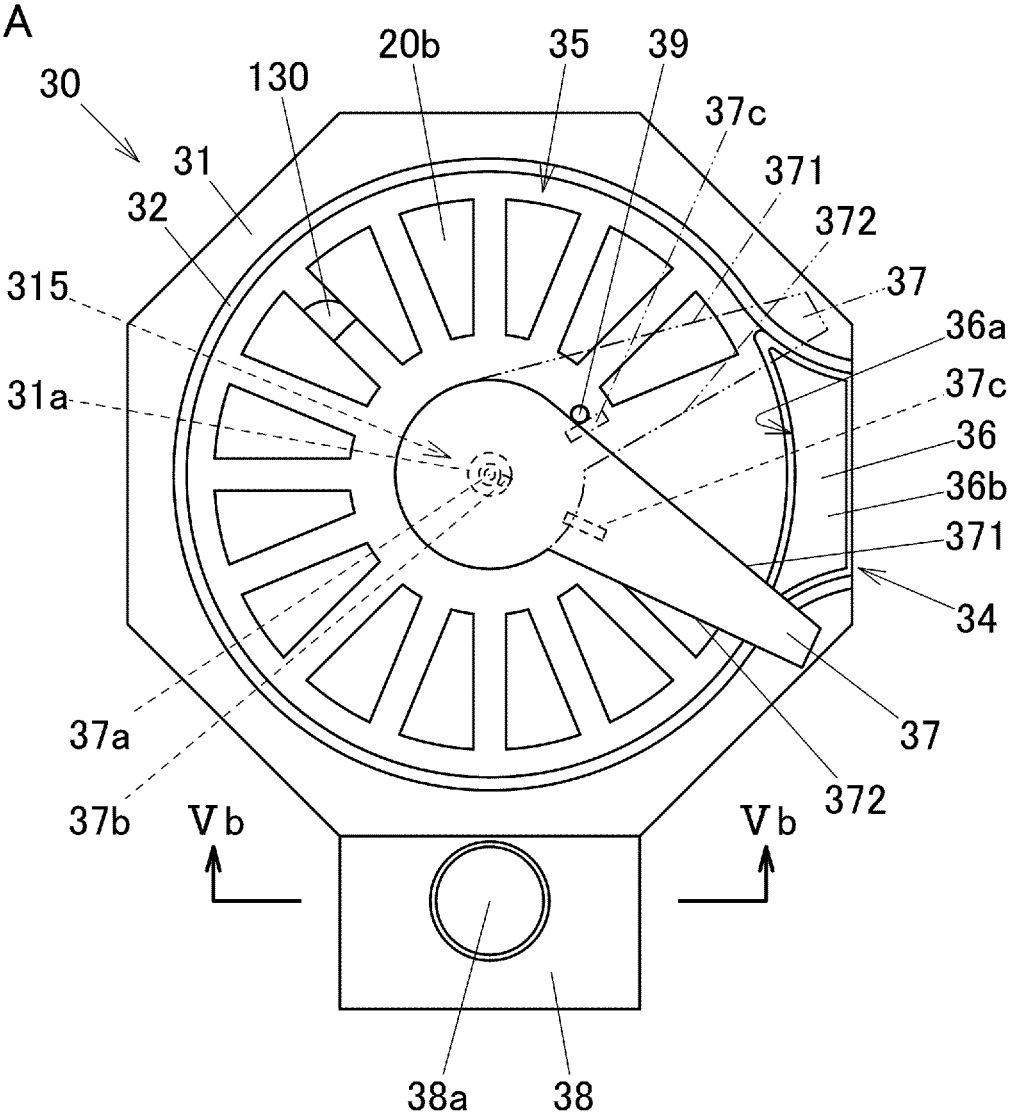
FIG. 5A is a schematic plan view of a rotational device of the track running toy according to the embodiment of the present invention.
Figure 5B:
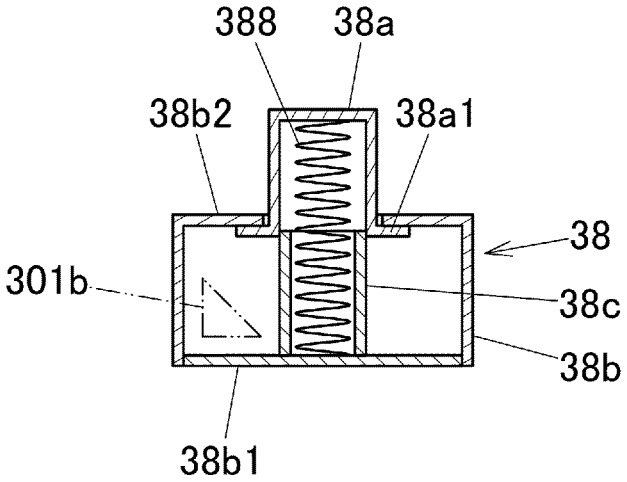
FIG. 5B is a schematic sectional end view, taken along a line Vb-Vb in FIG. 5A, of the rotational device of the track running toy according to the embodiment of the present invention.

An operating portion 38, which has the operating body 38*a* configured as a push button, is provided to a side of the track surface main body 31. As shown in FIG. 5B, an operating body guide tube 38*c*, which is erected from a bottom plate 38*b*1, is provided inside a box-shaped operating portion main body 38*b* of the operating portion 38. The operating body guide tube 38*c* can be inserted into the operating body 38*a*, which has a bottomed cylindrical shape, and a coil spring 388 is provided between the operating body guide tube 38*c* and the operating body 38*a*. The operating body 38*a* is biased upwards by the coil spring 388. The operating body 38*a* is restricted from moving upwards as a result of a flange portion 38*a*1, which is formed at a lower end of the operating body 38*a*, being brought into abutment with an inner surface of an upper plate 38*b*2 of the operating main body portion 38*b*.

Figure 7B:
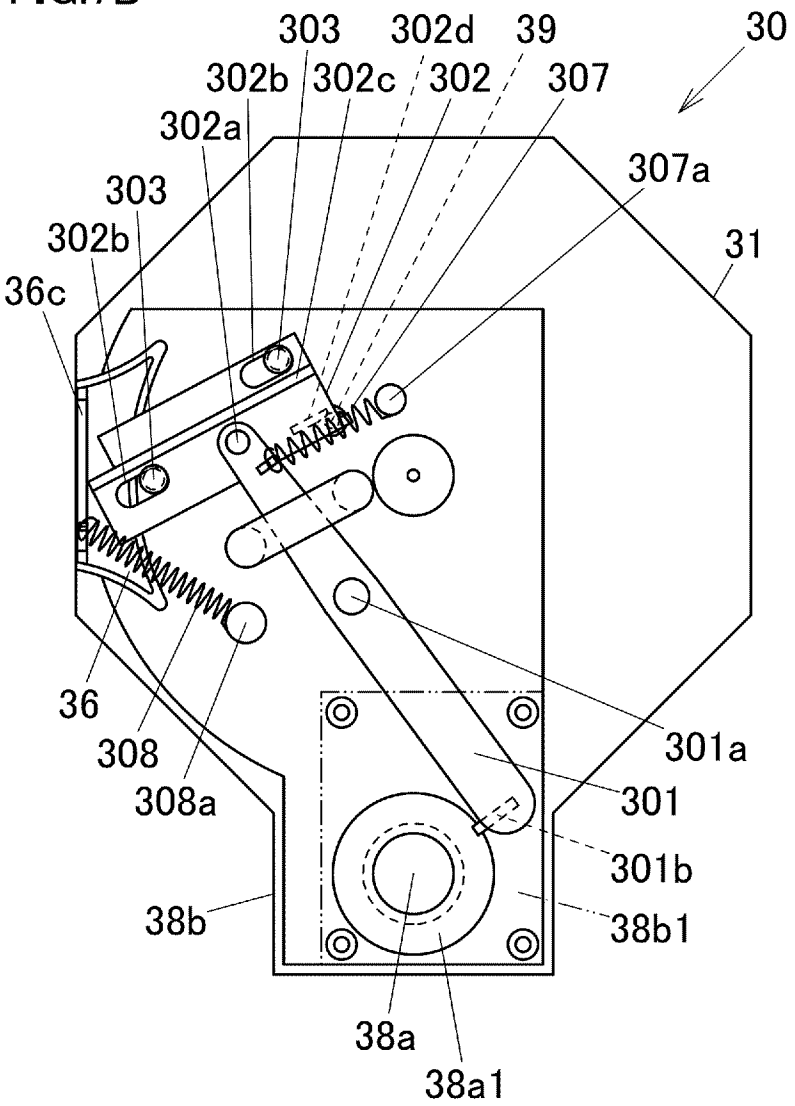
FIG. 7B is the schematic bottom view of the rotational device of the track running toy according to the embodiment of the present invention, showing a state in which the operating body is operated.
Figure 7A:
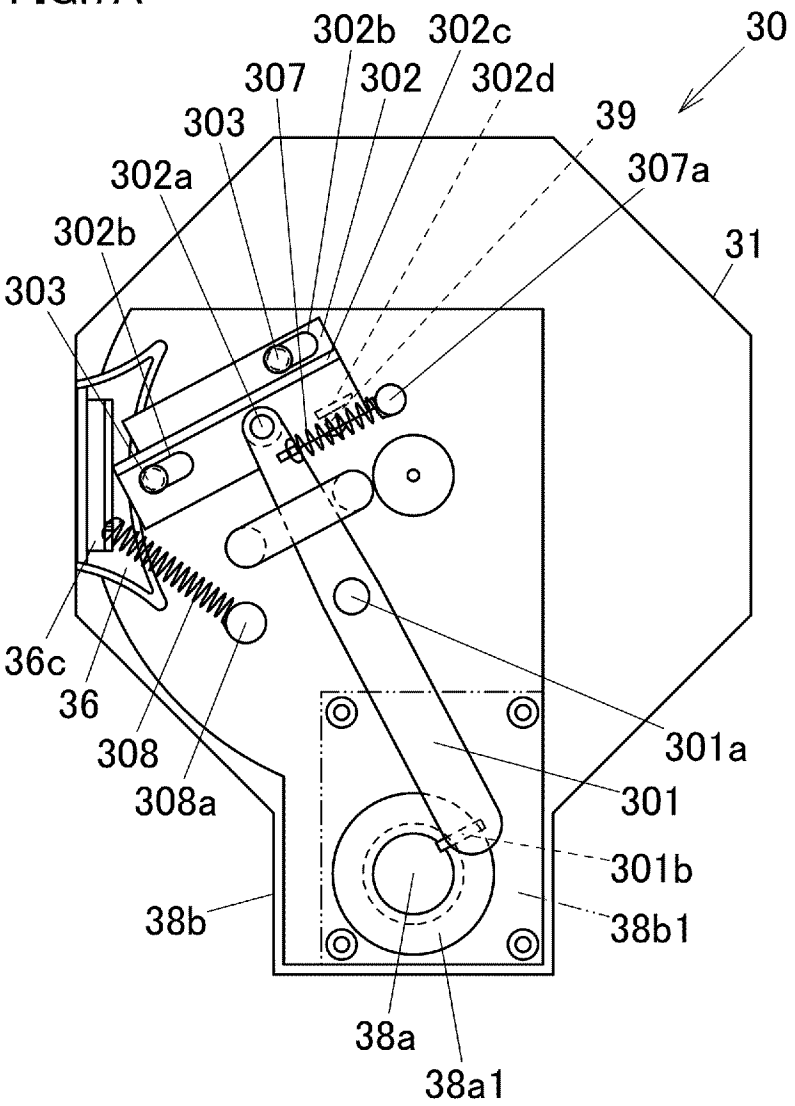
FIG. 7A is a schematic bottom view of the rotational device of the track running toy according to the embodiment of the present invention, showing a state in which an operating body is not operated.
Figure 8:
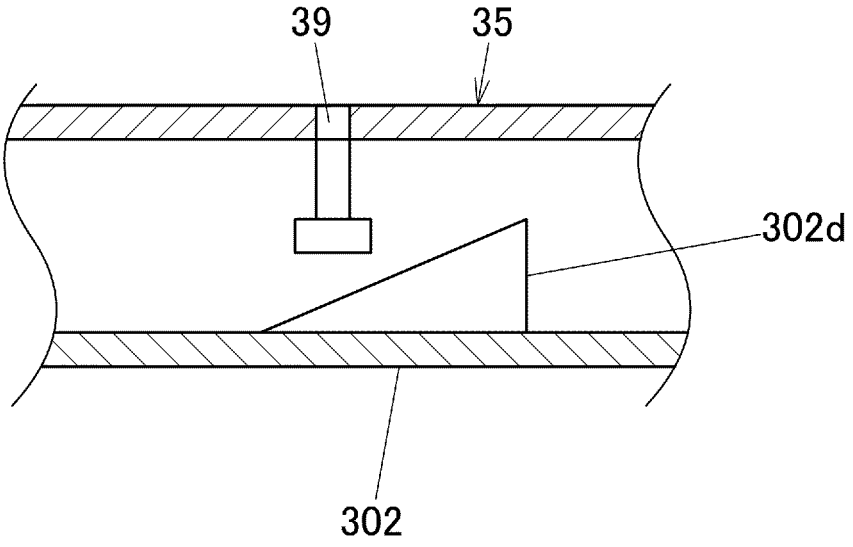
FIG. 8 is a schematic vertical sectional view showing a periphery of a pop-up abutment portion of a rotational operating body of the track running toy according to the embodiment of the present invention.

As shown in FIGS. 7A, 7B, a long rotational rod 301 is provided in such a manner as to extend from a side of the operating body 38*a* towards the pop-up abutment member 39. The rotational rod 301 is supported rotatably at a substantially central position in a longitudinal direction thereof by a shaft portion 301*a*. The rotational rod 301 is coupled rotatably with an oscillating plate 302 by a coupling shaft 302*a*. The rotational rod 301 connects to one end of a coil spring 307 at an end thereof which faces the oscillating plate 302. The other end of the coil spring 307 is fixed to a fixing portion 307*a* of the track surface main body 31. The coil spring 307 is set in a natural length (or in a tensile direction) in a state in FIG. 7A (a state in which the flange portion 38*a*1 of the operating body 38 and a flange sliding portion 301*b*, which will be described later, are not in abutment with each other). The oscillating plate 302 has a substantially rectangular shape, and two elongated holes 302*b* are provided in corner portions which face each other diagonally. Guide pins 303, which are erected from a lower surface of the track surface main body 31, are inserted individually in the corresponding elongated holes 302*b*, whereby the oscillating plate 302 is guided so as to move rectilinearly in a longitudinal direction of the oscillating plate 302. A rib 302*c*, which extends in the longitudinal direction of the oscillating plate 302, is provided between the elongated holes 302*b* in a short side or transverse direction of the oscillating plate 302. An abutment member sliding portion 302*d*, having a substantially right-angled triangular shape, is formed on an upper surface (a side facing the track surface main body 31) of the oscillating plate 302 in such a manner as to correspond to the pop-up abutment member 39 (refer to FIG. 8). In addition, as indicated by chain double-dashed lines also in FIGS. 7A, 7B, 5B, the flange sliding portion 301*b*, having a substantially right-angled triangular shape, is formed on the end of the rotational rod 301 which faces the operating body 38*a* in such a manner as to correspond to the flange portion 38*a*1.

Figure 9:
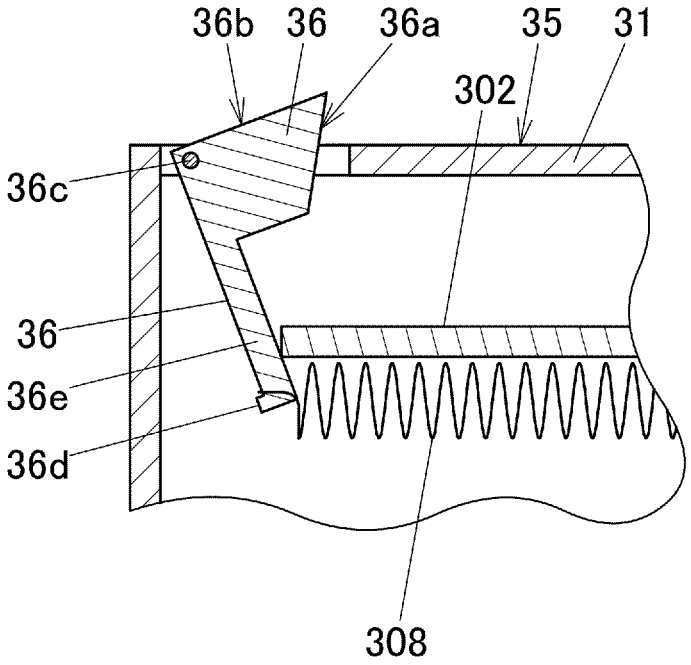
FIG. 9 is a schematic vertical sectional view showing a periphery of an entry and exit control device of the track running toy according to the embodiment of the present invention.

As shown in FIG. 9, in the entry and exit control member 36, a shaft 36*c* is provided at a bent or corner portion of the substantially L-like shape in a side view in such a manner that an axial direction of the shaft 36*c* is directed in a longitudinal direction of the entry and exit control member 36, whereby the entry and exit control member 36 is provided rotatably (in such a manner as to tilt). A side of the entry and exit control member 36 of the substantially L-like shape, which is opposite to the side where the pop-up guide portion 36*a* is provided and on which an end portion 36*d* is provided, is made into an abutment plate 36*e*, and one end of a coil spring 308 is connected to the end portion 36*d*. The other end of the coil spring 308 is fixed to a fixing portion 308*a* (refer to FIGS. 7A, 7B) of the track surface main body 31. The coil spring 308 is provided in a tensioned state. As a result, with no external force applied to the entry and exit control member 36, the pop-up guide portion 36*a* projects from the track surface 35 (a state shown in FIG. 9). In addition, a corner portion of the oscillating plate 302 is in abutment with the abutment plate 36*e* of the entry and exit control member 36 at all times.

When depressing the operating body 38*a* from the state shown in FIG. 7A, the flange portion 38*a*1 of the operating body 38*a* is lowered to be brought into abutment with a sloping portion of the flange sliding portion 301*b* (also, refer to FIG. 5B). With the flange portion 38*a*1 staying in abutment with the flange sliding portion 301*b*, when depressing further the operating body 38*a*, the flange portion 38*a*1 is lowered further, whereby the flange sliding portion 301*b* moves in a direction in which the flange sliding portion 301*b* moves away from the flange portion 38*a*1 against a biasing force of the coil spring 307. When the operating body 38*a* lowers to its lower limit, the rotational rod 301 and the oscillating plate 302 are positioned as shown in FIG. 7B.

As the flange sliding portion 301*b* so moves, the rotational rod 301 rotates counterclockwise about the shaft portion 301*a* as viewed in FIG. 7A against the biasing force of the coil spring 307. Then, the oscillating plate 302 moves towards the entry and exit control member 36. When the oscillating plate 302 moves, and the abutment plate 36*e* is pushed by the oscillating plate 302, the entry and exit control member 36 tilts towards the track surface 35, whereby the running surface 36*b* is positioned substantially parallel to or level with the track surface 35. In addition, as the oscillating plate 302 moves, the abutment member sliding portion 302*d* moves towards the pop-up abutment member 39. Then, a sloping portion of the abutment member sliding portion 302*d* is brought into abutment with a portion on the pop-up abutment member 39 which lies in the vicinity of a lower end thereof, whereby the pop-up abutment member 39 is caused to project from the track surface 35.

The rotational device 30 operates as will be described below. When the self-propelled running body 100 enters the rotational device 30 from the entry and exit portion 34 in the state shown in FIG. 5A, the self-propelled running body 100 comes into abutment with the entry guide portion 371 of the entry and exit guide member 37 and is guided along the entry guide portion 371. When the self-propelled running device 100 comes into abutment with the entry guide portion 371, since the cam follower 37*b* of the entry and exit guide member 37 is in engagement with the engagement step portion 313 on the cam surface 31*a*1 of the cam portion 31*a*, even though a counterclockwise force is applied to the entry and exit guide member 37 as viewed in FIG. 5A, the entry and exit guide member 37 never rotates, whereby the self-propelled running body 100 is guided by the entry guide portion 371. The engagement step portion 313 may be formed into a recessed groove or the like so as to be brought into engagement with the cam follower 37*b*. The self-propelled running body 100, which is being guided by the entry guide portion 371, runs on the track surface 35 along the track guide portion 32. The self-propelled running body 100, which is moving along the track guide portion 32, comes into abutment with the exit guide portion 372 of the entry and exit guide member 37. When the self-propelled running body 100 comes into abutment with the exit guide portion 372, the self-propelled running body 100 itself then runs on the track surface 35 around a center axis of the track guide portion 32 while pushing to rotate the entry and exit guide member 37 at a front surface portion thereof. As this occurs, the self-propelled running body 100 is guided not only by the track guide portion 32 but also by the pop-up guide portion 36*a* of the entry and exit control member 36 at the entry and exit portion 34.

When depressing the operating body 38*a* at an arbitrary timing in the midst of the self-propelled running body 100 running round and round on the track surface 35, the pop-up abutment member 39 projects from the track surface 35. Then, the stopping abutment portion 37*c* of the entry and exit guide member 37 comes into abutment with the pop-up abutment member 39, whereby the entry and exit guide member 37 stops in the position indicated by the chain double-dashed line in FIG. 5A. In addition, the entry and exit control member 36 tilts at the same time as depressing the operating body 38*a*, whereby the running surface 36*b* connects to the track surface 35. Then, the self-propelled running body 100 moves along the exit guide portion 372 to be guided to the entry and exit portion 34 and passes through the running surface 36*c* to exit from the rotational device 30.

That is, the track surface main body 31 of the rotational device 30 has the track surface 35, which is formed so that the self-propelled running body 100 can run along the track guide portion 32, and the entry and exit portion 34, through which the self-propelled running body 100 enters and exits from the track surface 35. Then, the entry and exit guide member 37 has the entry guide portion 371, which is configured to guide the self-propelled running body 100 entering from the entry and exit portion 34 to the track surface 35, and the exit guide portion 372, which is configured to guide the self-propelled running body 100 exiting from the entry and exit portion 34 to the entry and exit portion 34. Then, the entry and exit guide member support portion 315 is formed so that the entry guide portion 371 and the exit guide portion 372 can move along the track surface 35. In addition, the entry and exit control member 36 is provided at the entry and exit portion 34 and has the pop-up guide portion 36*a*, which is formed in such a manner as to follow the track guide portion 32, and the running surface 36*b*, on which the self-propelled running member 100 can run. The entry and exit control member 36 projects while tilting and is retracted when the operating body 38*a* is operated, allowing the running surface 36*b* to connect to the track surface 35. Then, the pop-up abutment member 39 is configured so as to be switched from the retracted state to the projecting state as the operating body 38*a* is operated, and when staying in the projecting state, the pop-up abutment member 39 comes into abutment with the stopping abutment portion 37*c* of the entry and exit guide member 37, causing the exit guide portion 372 to function.

As a result, since the track running toy 10 includes the rotational device 30 which enables the self-propelled running body 100, which is being self-propelled, not only to enter it via the same entry and exit portion 34 to run therein as if confined therein but also to exit therefrom through the same entry and exit portion 34 at an arbitrary timing, the player can enjoy more playing with the track running toy 10 not only by watching the track running toy 10 running but also by adding the active play, and further, the track running toy 10 can be formed compact. Thus, the track running toy 10 can be provided with which an infant can enjoy playing sufficiently although the track running toy 10 is formed compact.

The entry and exit guide member support portion 315 has the pin member 37*a*, which is the rotational shaft provided at the center of the track surface 35 to support rotatably the entry and exit guide member 37, and the cam portion 31*a*, which is formed on the outer circumference of the pin member 37*a*. The cam portion 31*a* causes the entry and exit guide member 37 to stop in the position where the entry guide portion 371 is made to function by the self-weight of the entry and exit guide member 37 (that is, the position where the cam follower 37*b* comes into engagement with the engagement step portion 313). As a result, the entry and exit guide member 37 can be made to deal with the self-propelled running body 100, which is entering the track surface 35, without involving any special operation.

Additionally, the entry guide portion 371 and the exit guide portion 372 are provided in such a manner as to face each other. This enables the rotational device 30 to be formed more compact in size.

Figure 10B:
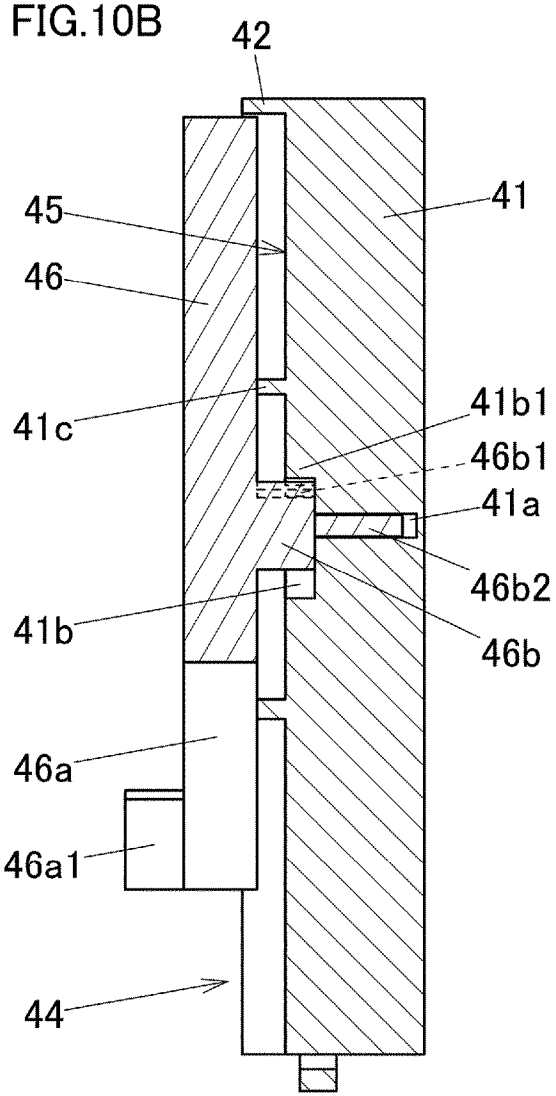
FIG. 10B is a schematic sectional view, taken along a line Xb-Xb in FIG. 10A, of the reversing device according to the embodiment of the present invention.

Next, referring to FIGS. 10A, 10B, the reversing device 40 will be described in detail. In the reversing device 40, a circular track surface 45 (a reversing track surface) is formed on an upper surface of a reversing device main body 41, and a track guide portion 42 (a reversing guide portion) is erected into a wall-like shape on an outer edge of the track surface 45. An entry and exit portion 44 (a reversing entry and exit portion), from which the track surface 45 and the track guide portion 42 are provided to extend outwards, is provided on the reversing device main body 41 of the reversing device 40. The self-propelled running body 100 enters the track surface 45 through the entry and exit portion 44. A reversing rotational table 46 is provided on the track surface 45. The reversing rotational table 46 is formed into a plate-like shape having a certain thickness and is formed into a substantially sectorial shape having an internal angle of about 120 degrees as viewed from above. In the reversing rotational table 46, two radius portions (straight-line portions) of the sector each constitute a reversing guide portion 46*a*, and abutment wall portions 46*a*1 are erected upwards individually at two end portions of the reversing guide portions 46*a*. A rotational cylinder 46*b* is provided at a center of the reversing rotational table 46 in such a manner as to project therefrom towards the reversing device main body 41. A projection 46*b*1, projecting radially outwards, is provided on the rotational cylinder 46*b*. A pin-shaped shaft portion 46*b*2 is provided at an end portion of the rotational cylinder 46*b* in such a manner as to be directed towards the reversing device main body 41. The rotational cylinder 46*b* is formed thicker than a shaft portion 46*b*2.

A shaft hole 41*a*, into which the shaft portion 46*b*2 is inserted, is provided at a center of the track surface 45 of the reversing device main body 41. A counterbored reversing cam portion 41*b*, which is counterbored in the shaft hole 41*a*, is formed on an upper side of the shaft hole 41*a*. The reversing cam portion 41*b* includes an arced wall surface 41*b*1 of a curvature matching the rotational cylinder 46*b*. An abutment surface 41*b*2 is formed at each end of the arced wall surface 41*b*1 in such a manner as to extend therefrom radially outwards. The abutment surfaces 41*b*2 are set so that the abutment surfaces 41*b*2 intersect each other at an intersection angle of about 120 degrees. The projection 46*b*1 on the rotational cylinder 46*b* can be brought into abutment with the abutment surfaces 41*b*2. As a result, the reversing rotational table 46 can rotate through a predetermined angle (about 240 degrees in the present embodiment) at which the projection 46*b*1 moves from one of the abutment surfaces 41*b*2 to the other thereof for abutment. A configuration can be adopted in which by providing a weight on the reversing rotational table 46 as required, with no external force applied to the reversing rotational table 46, the projection 46*b*1 is positioned in a position where the projection 46*b*1 is in abutment with either of the abutment surfaces 41*b*2. In addition, a rib 41*c*, having an annular shape in a plan view, is provided on an outer side of the reversing cam portion 41*b*. This annular rib 41*c* has an apex portion 41*c*1 formed on a side facing the entry and exit portion 44. As viewed from above, the annular rib 41*c* supports rotatably a lower surface of the reversing rotational table 46 on an upper end face thereof.

Figure 10A:
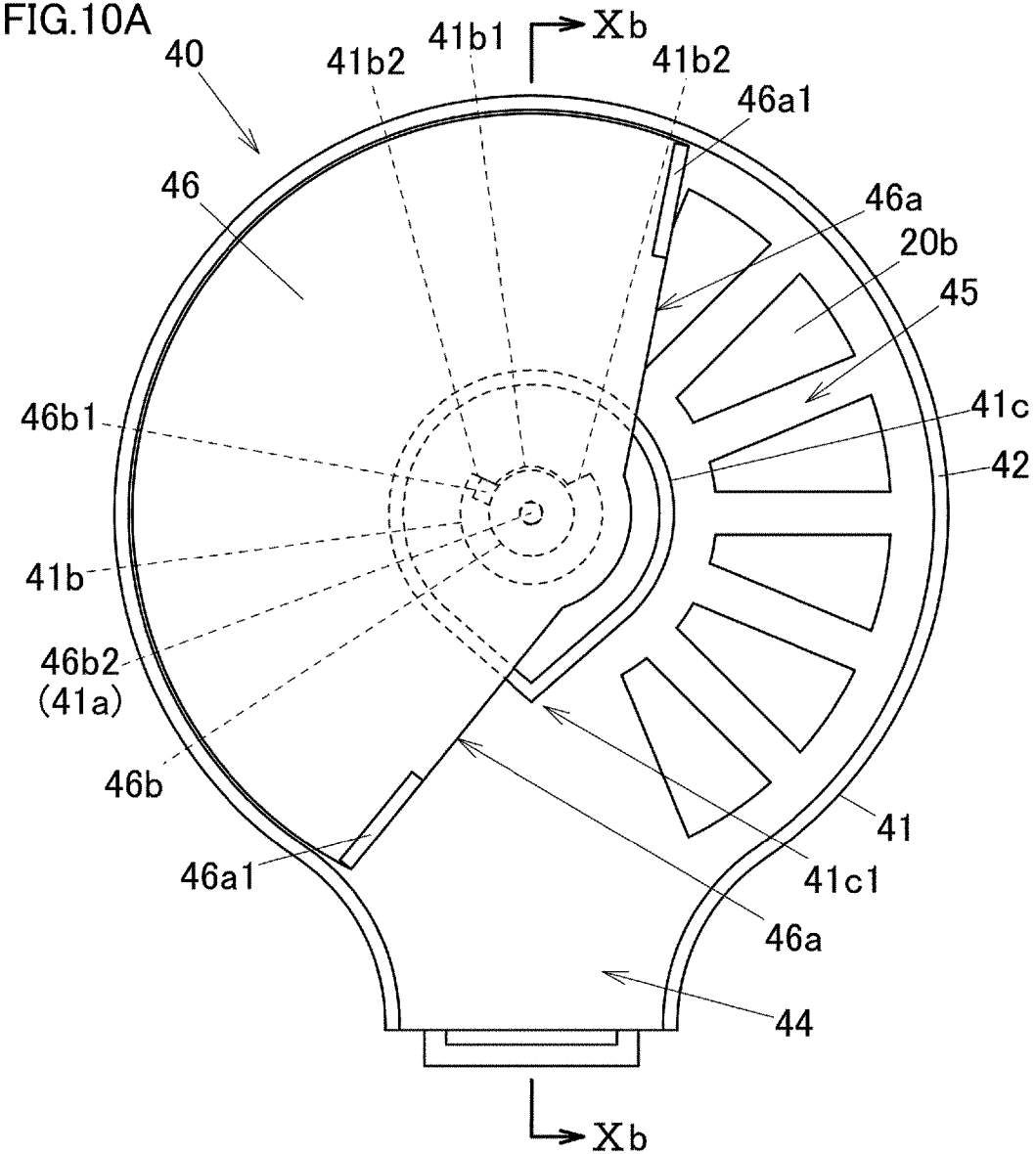
FIG. 10A is a schematic plan view showing a reversing device of the track running toy according to the embodiment of the present invention.

When the self-propelled running body 100 enters the entry and exit portion 44 of the reversing device 40 in a state shown in FIG. 10A, the self-propelled running body 100 comes into abutment with the abutment wall portion 46*a*1 located closer to the entry and exit portion 44 and then moves along the reversing guide portion 46*a* on which the abutment wall portion 46*a*1, with which the self-propelled running body 100 comes into abutment, is provided. Then, the self-propelled running body 100 arrives at the other reversing guide portion 46*a* (the reversing rotational table 46). Then, the self-propelled running body 100 moves on the circular track surface 45 along the track guide portion 42 while pushing the reversing guide portion 46*a*. When the reversing rotational table 46 rotates, bringing the projection 46*b*1 into abutment with the abutment surface 41*b*2, the self-propelled running body 100 is guided towards the entry and exit portion 44 along the reversing guide portion 46*a* which the self-propelled running body 100 pushes while being in abutment therewith. In this way, the self-propelled running body 100 which enters the reversing device 40 exits from the entry and exit portion 44.

Figure 11A:
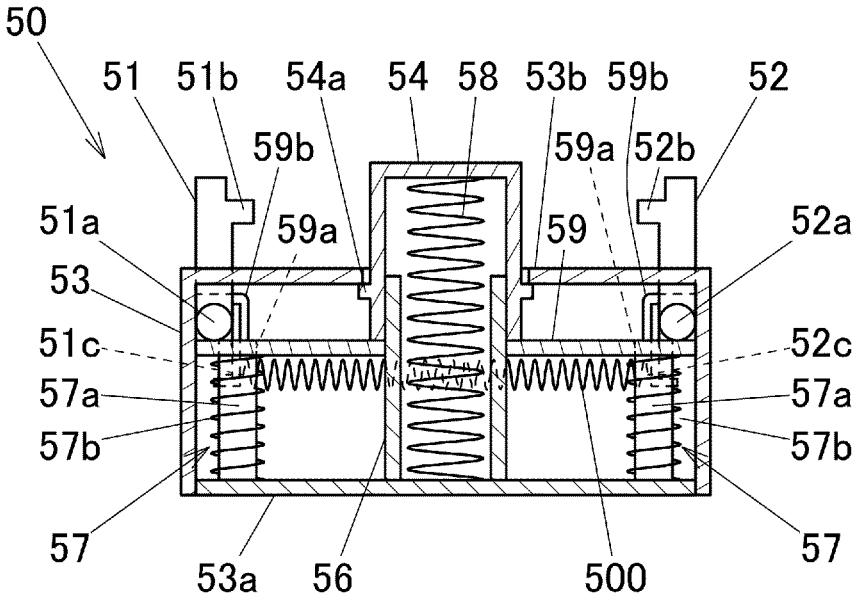
FIG. 11A is a sectional view, taken along a line XI-XI in FIG. 2, of a start platform of the track running toy according to the embodiment of the present invention, showing a state in which a push button is not depressed.
Figure 11B:
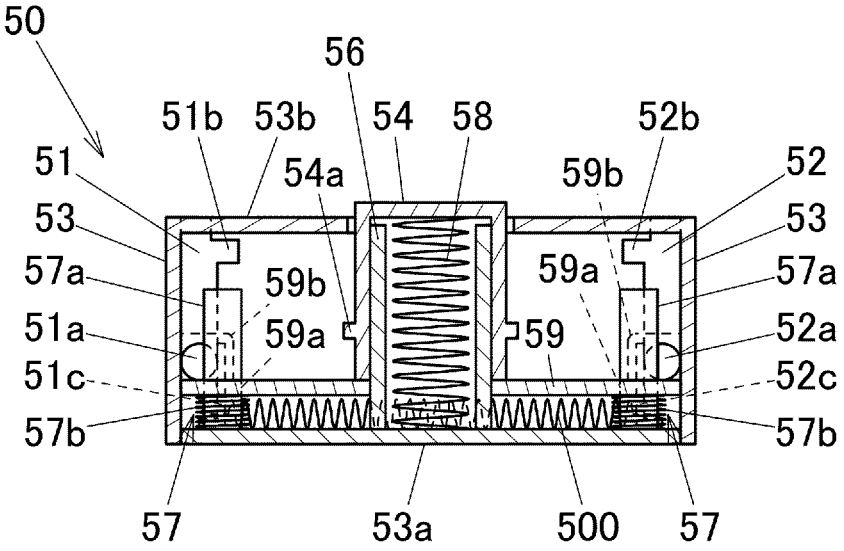
FIG. 11B is a sectional view, taken along the line XI-XI in FIG. 2, of the start platform of the track running toy according to the embodiment of the present invention, showing a state in which the push button is depressed.

Next, referring to FIGS. 2, 11A and 11B, the start platform 50 will be described in detail. The start platform 50 includes the straight-line track surface 55 on an upper surface thereof and also includes a platform main body 53 having a substantially box-like shape. The start platform 50 can be integrated with the pedestal 25*d* of the rotational track 25. A bottomed cylindrical push button 54 is provided on the base main body 53, which is located on a nearer side (a side opposite to a side facing the rotational track 25) of the track surface 55 of the start platform 50. The push button 54 can also be made up of various types of operating bodies. The push button 54 includes an annular rib 54*a* in the vicinity of a lower opening portion. A cylindrical guide tube 56 is erected from a bottom plate 53*a* of the base main body 53. The guide tube 56 is inserted into the opening portion of the push button 54, and a coil spring 58 is provided in a compressed state between a portion of the bottom plate 53*a* which lies inside the guide tube 56 and the push button 54. The push button 54 is restricted from moving upwards as a result of the annular rib 54*a* coming into abutment with an upper plate 53*b* of the base main body 53.

In addition, a lower end of the push button 54 is fixed to an intermediate plate 59 which is disposed inside the base main body 53. The intermediate plate 59 is provided as having a rectangular flat plate-like shape inside the base main body 53, and hole portions 59*a* are formed individually in four corners of the intermediate plate 59. Guide posts 57*a* of guide portions 57, which are disposed individually for the four corners of the intermediate plate 59, are inserted in the hole portions 59*a*. Coil springs 57*b*, which are wound individually around the guide posts 57*a* of the guide portions 57, are provided between the intermediate plate 59 and the bottom plate 53*a*. The coil spring 57*b* is disposed in a natural length or in a slightly compressed state in an upper limit position of the push button 54 in FIG. 11A. In addition, bearing portions 59*b*, which are configured so as to support rotatably shafts 51*a*, 52*a* of the locking rods 51, 52, are provided on the intermediate plate 59. The shafts 51*a*, 52*a* of the locking rods 51, 52 protrude from lower ends of the locking rods 51, 52, respectively, towards a width direction of the track surface 55. Projecting portions 51*b*, 52*b*, which project towards each other, are formed in the vicinity of upper end portions of the locking rods 51, 52, respectively. Extending portions 51*c*, 52*c*, which project from the intermediate plate 59 and extend longer than the shafts 51*a*, 52*a*, are formed at lower ends of the locking rods 51, 52, respectively. A coil spring 500 is provided between the extending portions 51*c*, 52*c* in such a manner as to be stretched between the extending portions 51*c*, 52*c*. The coil spring 500 is provided in a tensioned state. As a result, with no external force applied to the locking rods 51, 52, the locking rods 51, 52 are erected. Then, the locking rods 51 52 can tilt towards each other.

When the self-propelled running body 100 enters the track surface 55 of the start platform 50 from one end of the track surface 55, the entry side locking rod 51, 52 with which the self-propelled running body 100 comes into abutment tilts, and the projecting portion 51*b*, 52*b* of the other locking rod 51, 52 comes into abutment with the first switch 131 of the self-propelled running body 100. As this occurs, the first switch 131 is depressed, whereby the self-propelled running body 100 is stopped from being driven, and a preset voice or sound is emitted. Then, as shown in FIG. 11B, when the push button is depressed, the locking rods 51, 52 are retracted into an interior of the base main body 53 while the locking rods 51, 52 are kept erected (the entry side locking rod 51, 52 is gradually erected). Then, the abutment of the projecting portion 51*b*, 52*b* of the locking rod 51, 52 with the first switch 131 is released, whereby the first switch 131 which is depressed is restored to its normal position, and the self-propelled running body 100 is caused to start moving. When starting to use the track running toy 10, the self-propelled running body 100, whose power supply switch 102 is on, is placed on the track surface 55 of the start platform 50, whereby the first switch 131 is depressed by the projecting portion 51*b*, 52*b* of the locking rod 51, 52, and the self-propelled running body 100 starts moving by depressing the push button 54.

While the embodiment of the present invention has been described heretofore, the present invention is not limited to the embodiment in any way, and hence, the present invention can be carried out while being modified as required. For example, in place of the self-propelled running body 100 which imitates the locomotive, another type of self-propelled running body 100 can be employed which imitates an automobile or the like.

What is claimed is:

1. A track running toy comprising a rotational device, the rotational device comprising:

a track surface on which a self-propelled running body can run;

an entry and exit portion through which the self-propelled running body enters and exits the track surface;

an entry and exit guide member having side surfaces and a plate surface;

an entry and exit control member provided at the entry and exit portion configured to pop up and retract vertically at the entry and exit portion; and an operating body, wherein the track surface comprises a track guide portion that projects upward from the track surface to guide the self-propelled running body and a pop-up abutment member that can project upward from the track surface;

wherein the entry and exit guide member comprises an entry and exit guide member support portion, an entry guide portion, an exit guide portion, and a stopping abutment portion;

wherein the entry and exit guide member support portion supports the entry and exit guide member such that the plate surface can rotate along the track surface;

wherein the entry guide portion is provided on a first surface of the side surfaces along a radial direction when the entry and exit guide member rotates and the exit guide portion is provided on a second surface of the side surfaces along a radial direction when the entry and exit guide member rotates;

wherein the stopping abutment portion projects downward from the plate surface;

wherein the entry and exit control member comprises a running surface on which the self-propelled running body can run and a pop-up guide portion extending downward from the running surface, the pop-up guide portion projecting upward from the entry and exit portion to guide the self-propelled running body to the track guide portion; and wherein, when the operating body is operated, the pop-up abutment member on the track surface is configured to project from the track surface to come into abutment with the stopping abutment portion of the entry and exit guide member, thereby stopping the exit guide portion at a position that blocks the track surface in a running direction of the self-propelled running body and guides the self-propelled running body to the entry and exit portion; and the entry and exit control member retracts to connect the running surface and the track surface.

2. The track running toy comprising the rotational device according to claim 1, wherein;

the entry and exit member support portion comprises a rotational shaft provided at a center of the track surface to support the entry and exit guide member rotatably and a cam portion formed on an outer circumference of the rotational shaft, the entry and exit guide member further comprises a cam follower formed into a projecting shape; and the cam portion engages with the cam follower so that the entry and exit guide member, by a self-weight of the entry and exit guide member, blocks the track surface in a direction opposite to a running direction of the self-propelled running body and stops the entry and exit guide member in a position that guides the self-propelled running body from the entry and exit portion to a track surface in a running direction.

3. The track running toy according to claim 2, further comprising a reversing device, the reversing device comprising:

a reversing track surface on which the self-propelled running body can run;

a reversing entry and exit portion through which the self-propelled running body enters and exits the reversing track surface; and a reversing rotational table configured to allow the self-propelled running body entering from the reversing entry and exit portion to travel on the reversing track surface and exit from the reversing entry and exit portion, wherein the reversing track surface comprises a reversing guide portion formed in a wall-like shape along an outer edge and a reversing cam portion, and wherein the reversing rotational table is provided on the reversing track surface and comprises a projection configured to come into abutment with the reversing cam portion, and is configured to rotate by a predetermined angle.

4. The track running toy comprising the rotational device and the reversing device according to claim 3, wherein the self-propelled running body has a sensor switch on a lower surface thereof, and wherein an identification body for which the sensor switch reacts is provided on the track surface and the reversing track surface.

5. The track running toy comprising the rotational device according to claim 1, wherein the self-propelled running body has a sensor switch on a lower surface thereof, and wherein an identification body for which the sensor switch reacts is provided on the track surface wherein the entry guide portion and the exit guide portion are provided in such a manner as to face each other.

6. The track running toy according to claim 1, further comprising a reversing device, the reversing device comprising:

a reversing track surface on which the self-propelled running body can run;

a reversing entry and exit portion through which the self-propelled running body enters and exits the reversing track surface; and a reversing rotational table configured to allow the self-propelled running body entering from the reversing entry and exit portion to travel on the reversing track surface and exit from the reversing entry and exit portion, wherein the reversing track surface comprises a reversing guide portion formed in a wall-like shape along an outer edge and a reversing cam portion, and wherein the reversing rotational table is provided on the reversing track surface and comprises a projection configured to come into abutment with the reversing cam portion, and is configured to rotate by a predetermined angle.

7. The track running toy comprising the rotational device and the reversing device according to claim 6, wherein the self-propelled running body has a sensor switch on a lower surface thereof, and wherein an identification body for which the sensor switch reacts is provided on the track surface and the reversing track surface.

* * * * *